US007052295B1

(12) United States Patent
Lin

(10) Patent No.: US 7,052,295 B1
(45) Date of Patent: May 30, 2006

(54) SIMULATED SD MEMORY CARD CONVERTER

(75) Inventor: Chih-Chien Lin, Taipei Hsien (TW)

(73) Assignee: Chant Sincere Co., Ltd., Hsi Chih (TW)

( * ) Notice: Subject to any disclaimer, the term of this patent is extended or adjusted under 35 U.S.C. 154(b) by 0 days.

(21) Appl. No.: 11/082,844

(22) Filed: Mar. 18, 2005

(51) Int. Cl.
*H01R 13/62* (2006.01)

(52) U.S. Cl. ..... 439/159; 439/630; 439/760

(58) Field of Classification Search ..... 439/630, 439/760, 945–946, 159–160, 131, 188, 326, 439/541.5, 64, 79; 235/492; 361/684, 686, 361/737

See application file for complete search history.

(56) References Cited

U.S. PATENT DOCUMENTS

| | | | | |
|---|---|---|---|---|
| 6,900,982 | B1 * | 5/2005 | Chang et al. | 361/685 |
| 2002/0177335 | A1 * | 11/2002 | Tsuchioka | 439/76.1 |
| 2004/0033727 | A1 * | 2/2004 | Kao | 439/660 |
| 2005/0020137 | A1 * | 1/2005 | Tanaka et al. | 439/630 |
| 2005/0037671 | A1 * | 2/2005 | Yamada et al. | 439/677 |
| 2005/0101170 | A1 * | 5/2005 | Tanaka et al. | 439/159 |
| 2005/0159035 | A1 * | 7/2005 | Shih | 439/159 |

OTHER PUBLICATIONS

Internet printoputs showing TransFlash trademark.*

* cited by examiner

*Primary Examiner*—Michael C. Zarroli
(74) *Attorney, Agent, or Firm*—Bacon & Thomas, PLLC

(57) ABSTRACT

A simulated SD memory card converter comprises an upper cover, a lower cover, an envelope, a plurality of conducting terminals and a detecting/retaining arm. The conducting terminals and the envelope are enclosed between the upper cover and the lower cover. The space between the combined upper and lower covers further includes a receptacle for the insertion of a Trans Flash memory card, whose opening is located at the front end of the converter. The rear edge of the lower cover is provided with a deficit corner and a row of holes connected to the wide ends of the conducting terminals. The narrow ends of the conducting terminals are shrunk toward the front edge of the lower cover and folded upright at the tips thereof. The envelope confines the middle section of the conducting terminals and is retained in the mid-rear portion of the converter.

5 Claims, 5 Drawing Sheets

SIMULATED SD MEMORY CARD CONVERTER

BACKGROUND OF THE INVENTION (a) Field of the Invention

The present invention relates to memory card converters, more particularly to a simulated secure digital (SD) memory card converter for coupling a TRANS FLASH™ micro SD flash memory card to a standard SD memory card slot.

(b) Description of the Prior Art

To retrieve data from a TRANS FLASH™ micro SD flash memory card, a user has to insert it into a corresponding slot on a computer device. However, the majority of the computer devices in the market, such as desktop computers, notebook computers, palm computers, pocket computers, personal digital assistants (PDAs), digital cameras, mobile phones, electronic dictionaries and MP3 players, are not provided with a slot for the TRANS FLASH™ micro SD flash memory card. Therefore, the promotion and utilization of the TRANS FLASH™ micro SD flash memory card are limited. The present invention allows the connection of a TRANS FLASH™ micro SD flash memory card to a computer device through an SD card slot.

SUMMARY OF THE INVENTION

The primary objective of the present invention is to provide a simulated SD memory card converter for converting a TRANS FLASH™ micro SD flash memory card to a standard SD card, whereby a TRANS FLASH™ micro SD flash memory card, after being inserted into the simulated SD memory card converter, will be used with an SD card connector or a multi-purpose reader. Therefore, the limitation of the TRANS FLASH™ micro SD flash memory card can be largely reduced.

The various objects and advantages of the present invention will be more readily understood from the following detailed description when read in conjunction with the appended drawings.

DETAILED DESCRIPTION OF THE PREFERRED EMBODIMENTS

Figure 1:
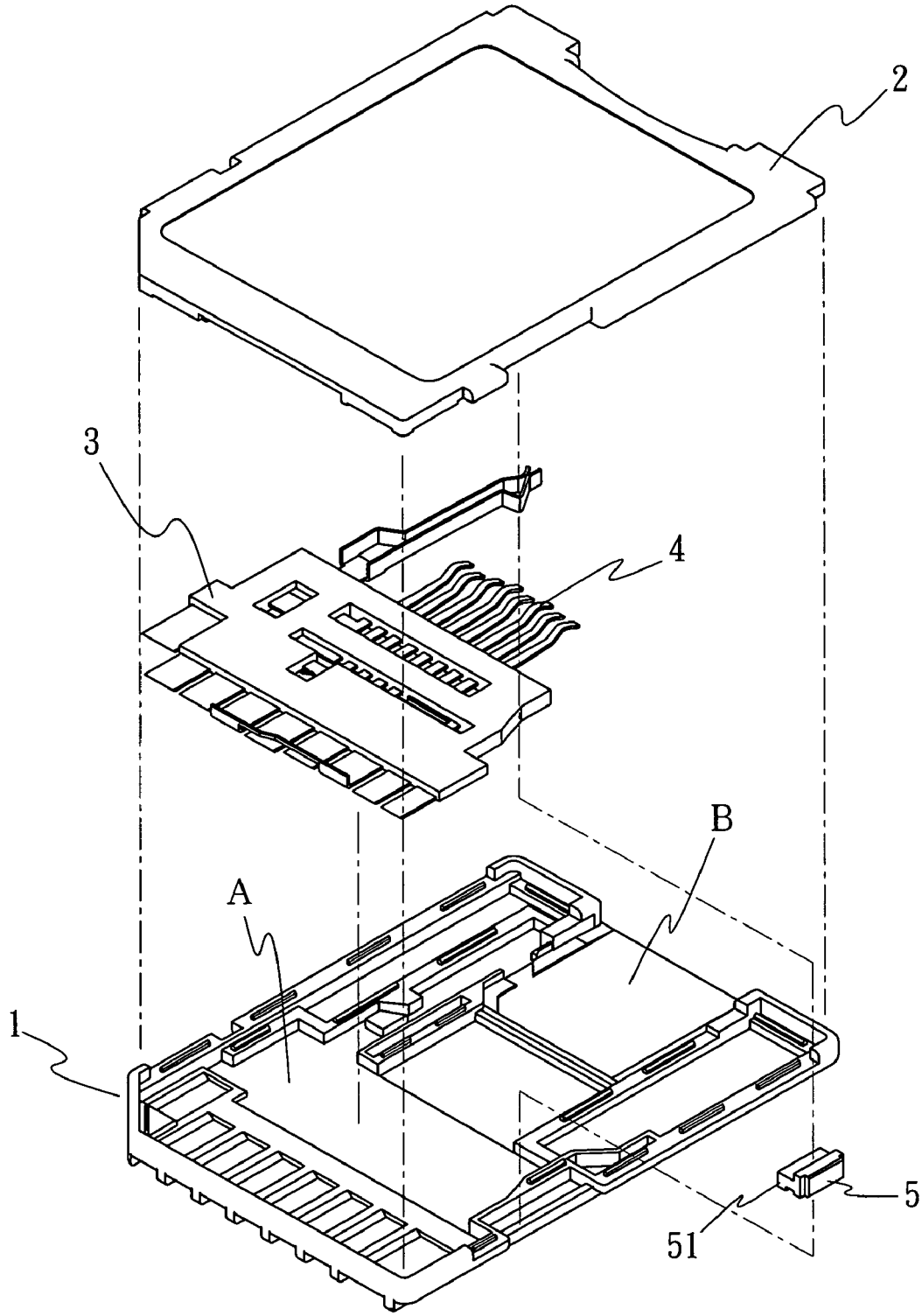
FIG. 1 is an exploded perspective view of a simulated SD memory card converter according to the present invention.
Figure 2:
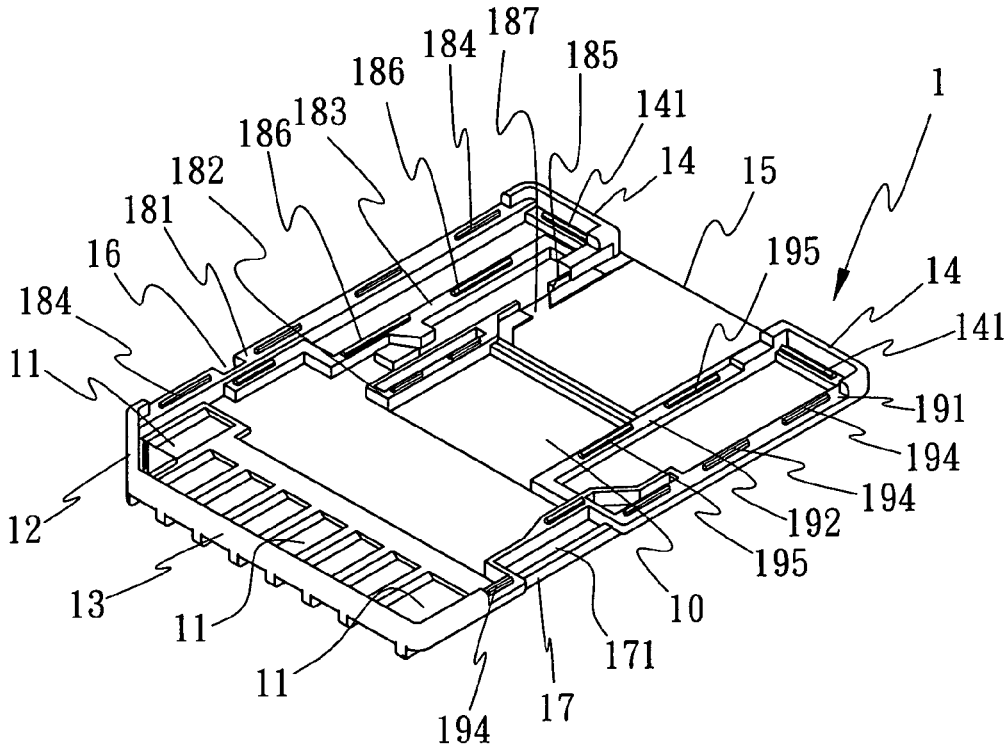
FIG. 2 is a perspective view of the lower cover of the simulated SD memory card converter in FIG. 1.
Figure 3:
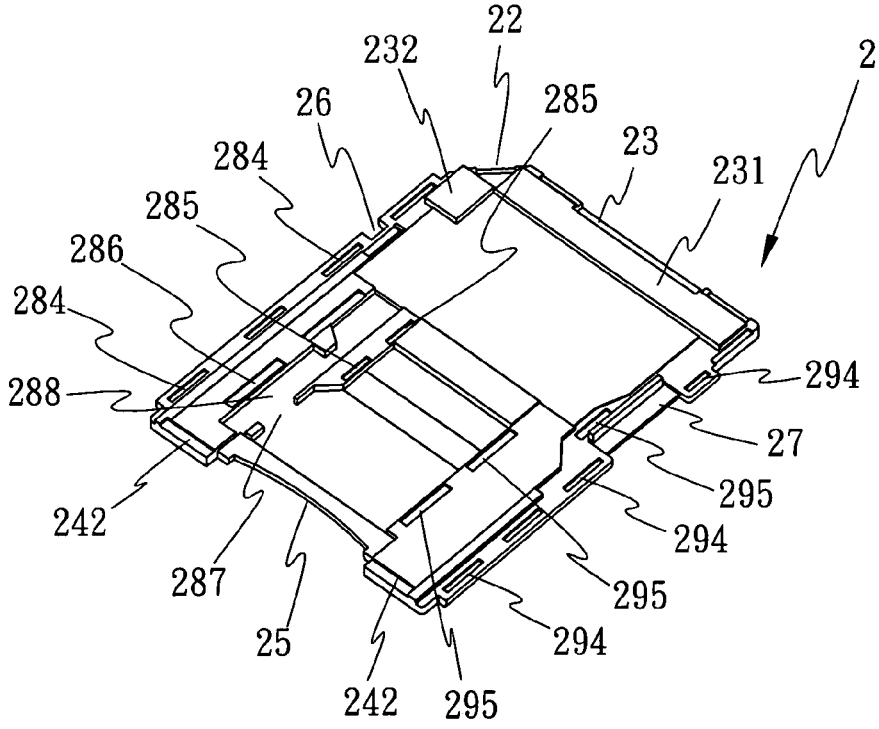
FIG. 3 is a perspective view of the upper cover in FIG. 1 being flipped over.

Referring to FIGS. 1 to 9, a simulated SD memory card converter according to the present invention comprises lower cover 1 and an upper cover 2. As the lower cover 1 and the upper cover 2 are combined, the combined body resembles a standard SD card, whereas the internal structure thereof is different.

The simulated SD memory card converter further comprises an envelope 3 and a set of conducting terminals 4 having a retaining arm 40, which will be enclosed in a space A defined by the inner space between the lower cover 1 and the upper cover 2. There exists a space B within the combined body for the insertion of a TRANS FLASH™ micro SD flash memory card 6.

Figure 4:
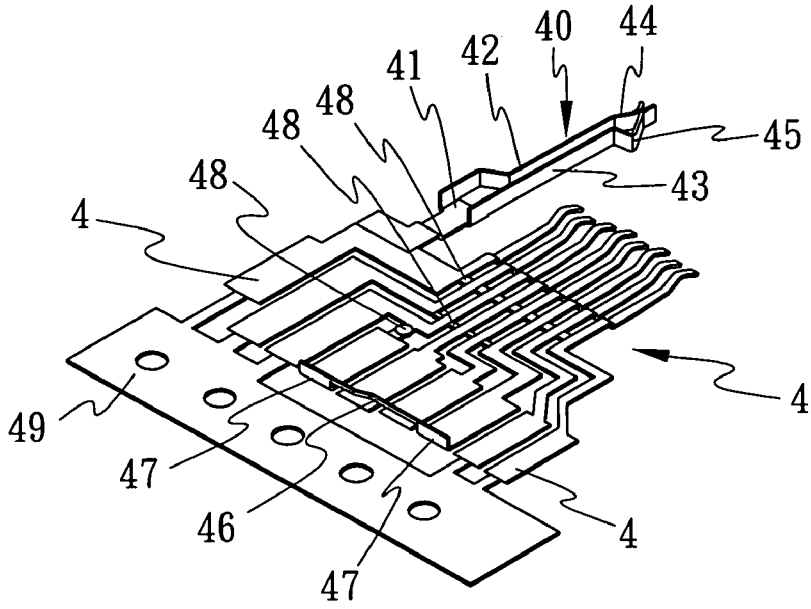
FIG. 4 is a perspective view of the set of conducting terminals in the simulated SD memory card converter in FIG. 1 including a base strip.
Figure 5:
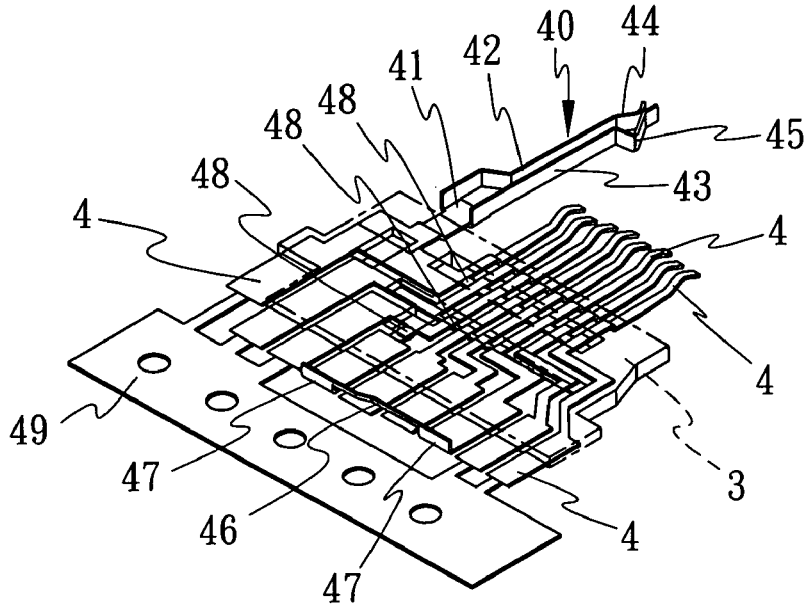
FIG. 5 indicates the set of conducting terminals in FIG. 4 enclosed in an envelope.
Figure 6:
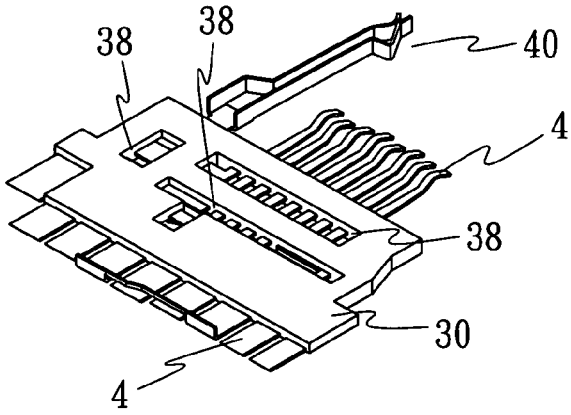
FIG. 6 is a perspective view of the set of conducting terminals in FIG. 4 enclosed in an envelope and after removal of the connecting strip.
Figure 7:
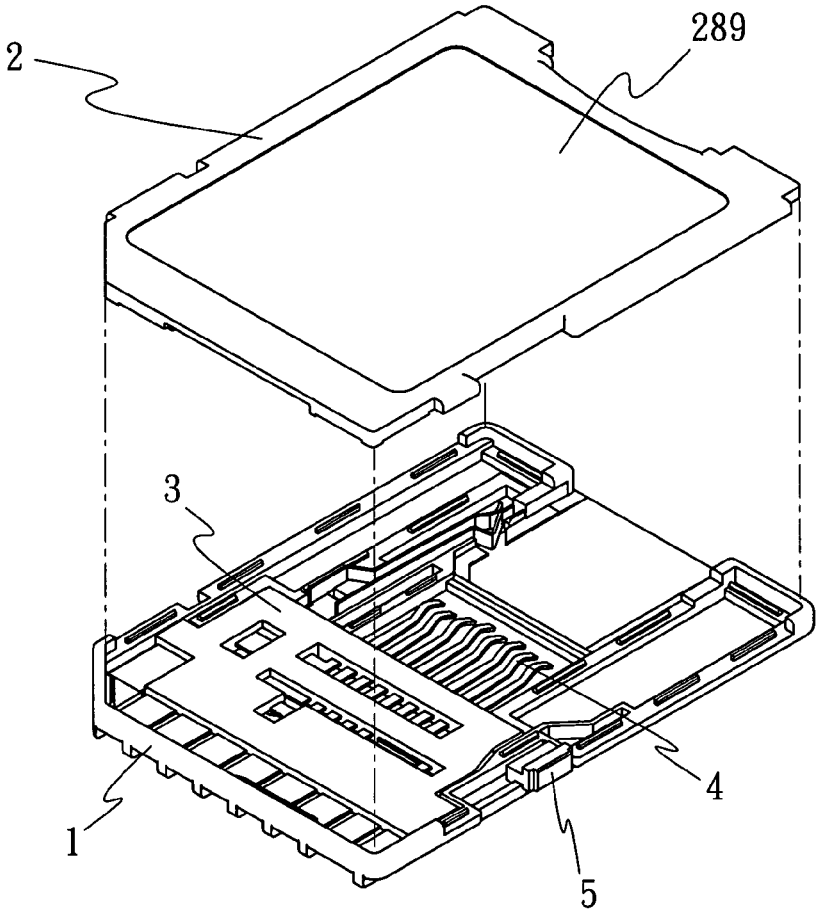
FIG. 7 is a perspective view of the set of conducting terminals and the associated envelope housed in the lower cover, whereas the upper cover is not engaged.

Referring to FIGS. 4 and 5, the conducting terminals 4 before being disposed between the lower cover 1 and the upper cover 2, are provided with a connecting strip 48 running across the conducting terminals 4 and a base strip 49 attached on the wider end of the conducting terminals 4. The connecting strip 48 and the base strip 49 are temperature parts which will be punched away during the process of combining the conducting terminals 4 and the envelope 3. The connecting strip 48 is for retaining each of the conducting terminals 4 in a right position, whereby the conducting terminals 4 will pass uniformly under a slot 38 on the envelope 3 and get retained in the slot 38. This a special production means of this present invention, called pre-confined injection molding, whereby the arrangement of the conducting terminals 4 will not be disturbed by the impact of the plastic envelope 3 during the manufacturing process.

The retaining arm 40 of the conducting terminals 4 is an extended member from the farthest left one of the conducting terminals 4, which includes a elongated conducting plate 41 retained by the envelope 3 and two upright guiding members 42, 43 respectively on two lateral sides of the conducting plate 41. The free end of the conducting plate 41 is provided with a bent section 44, and the front end of the guiding member 43 is provided with a hook 45.

The rear end of the lower cover 1 is provided with a row of holes 11 and a deficit corner 12. The one of the holes 11 nearest to the deficit corner 12 is locates in a forward position with respect to the others. Each of the holes 11 is aligned with a corresponding one of the conducting terminals 4 on the wide end of the set of conducting terminals 4.

On the narrow side, the conducting terminals 4 are converged, their tips being bent. There are nine of them, wherein the wide end of the sixth from the left is electrically connected to the wide end of the fourth by a connecting member 46. Further, the wide ends of the sixth and the fourth are folded upward.

The middle section of the set of conducting terminals 4 is covered by the envelope 3, and each of the conducting terminals 4 is well retained therein, whereby the conducting terminals 4 will be collaterally shrunk toward the front end of the converter in the horizontal direction. Accordingly, the envelope 3 has a corresponding shrunk portion, and the envelope 3 is housed in the rear portion of the converter.

The lower cover 1 further includes a depressed portion 10 on the central portion on the inner wall thereof. Along two lateral edges and the front edge of the inner wall of the lower cover 1, there form a plurality of projections, which correspond to a plurality of depressions along two lateral edges and the front edge of the inner wall of the upper cover 2. The front edges of the lower cover 1 and the upper cover 2 are respectively provided with a lower front opening 15 and a lower front opening 25; after being combined, the front openings form an inserting slot for a TRANS FLASH™ micro SD flash memory card. The rear edge of the upper cover 2 is further provided with a deficit corner 22 corresponding to the deficit corner 12.

The front edges of the lower cover 1 and the upper cover 2 are respectively provided with upright front flanges 14 and upright rear flanges 13, where the front edge and the rear edge of the upper cover 2 will be immersed in the lower cover 1. Further, the front flanges 14 are erected adjacent to two sides of the lower front opening 15, capable of being engaged with two corresponding depressions 242 formed on the upper cover 2.

On the left sides of the lower cover 1 and the upper cover 2, there respectively form breaches 16, 26. On the opposite sides of the lower cover 1 and the upper cover 2 at the same locations, there respectively form slider receptacles 17, 27 for retaining a slider 5. The lower cover 1 is further provided with a slider retaining groove 171 for the embedment of a rail side 51 of the slider 5.

The left and right lateral sides of the lower cover 1 are respectively provided with flanges 181, 182, 191 and 192. The flanges 181, 191 are located along the outer edges of the corresponding lateral sides, whereas the flanges 182, 192 are located inside for retaining the envelope 3. The flanges 182, 192 are arranged to converge toward the front edge of the lower cover 1, whereby the envelope 3 will not move forward. The flanges 181, 182, 191 and 192 are provided with a plurality of projections 184, 185, 194 and 195, and the upper cover 2 are provided with depressions 284, 285, 294 and 295 at locations corresponding to the flanges 181, 182, 191 and 192, whereby the combination of the lower cover 1 and the upper cover 2 will not only enclose the envelope 3 but also form engagements between the flanges 181, 182, 191 and 192 and the depressions 284, 285, 294 and 295 where an ultrasonic welding or a glue connection can be applied.

Figure 8:
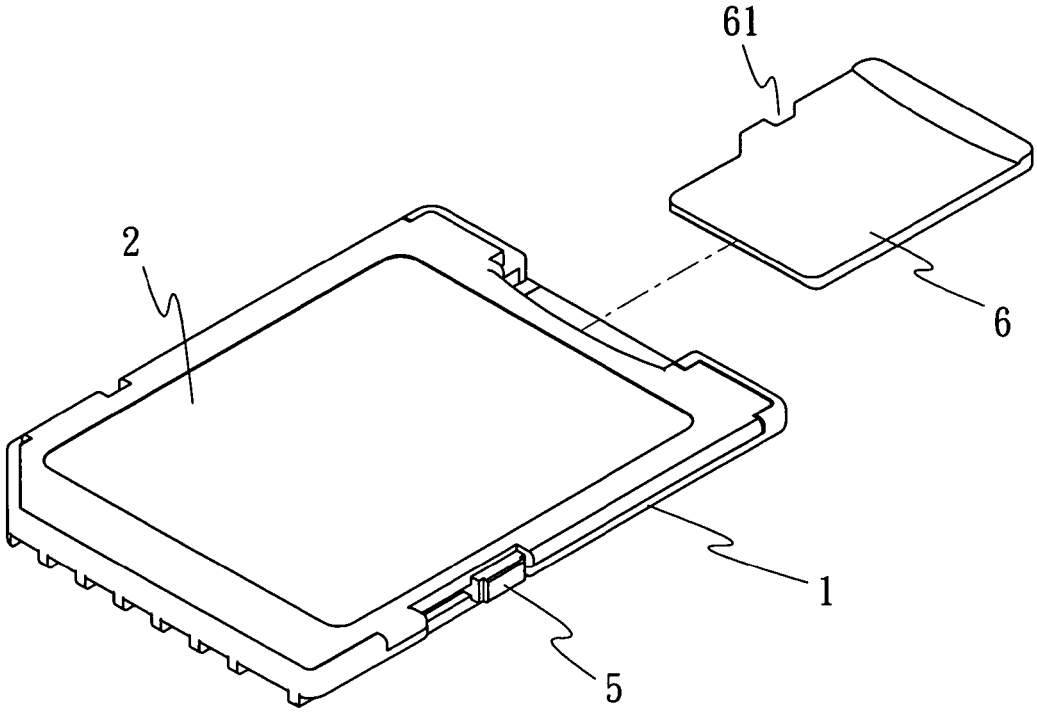
FIG. 8 shows the state of the simulated SD memory card converter before a TRANS FLASH™ micro SD flash memory card is inserted.
Figure 9:
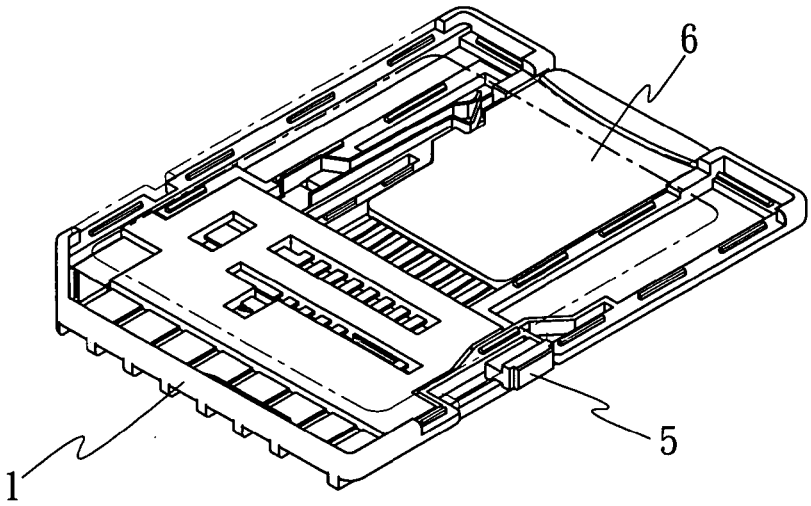
FIG. 9 is a perspective view of the set of conducting terminals, the associated envelope and a TRANS FLASH™ micro SD flash memory card housed between the lower cover and the upper cover.

To allow a forward movement of the inner guiding member 43, the lower cover 1 and the upper cover 2 are provided with breaches 187, 287 and a depressed portion 288 for the insertion of the guiding members 42, 43. Thereby, the hook 45 can go through a hole formed by the breaches 187, 287 to hook into an opening 61 on a TRANS FLASH™ micro SD flash memory card 6, as shown in FIGS. 8 and 9. There exists an inner flange 183 between the flanges 181, 182, on which a plurality of projections 186 are provided. The projections 186 are capable of being engaged with a corresponding plurality of depressions 286 on the upper cover 2. The upper cover 2 is further provided with a shallow recess 289 for the attachment of a label.

The above structure of a converter is particularly suitable for precision and easy assembly of a set of conducting terminals and the associated envelope. After being inserted, the pins of a TRANS FLASH™ micro SD flash memory card are connected through the narrow ends of the conducting terminals to the wide ends, where the connection pins of a standard SD card are simulated. Therefore, a TRANS FLASH™ micro SD flash memory card will be accepted by electronic devices that are compatible with SD cards, significantly enlarging the applicability of the TRANS FLASH™ micro SD flash memory card.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A simulated secure digital (SD) memory card converter, comprising:

an upper cover having a deficit corner at a rear edge thereof;

a lower cover being engaged with said upper cover to form a combined structure resembling an SD memory card, said combined structure having a main opening at a front end thereof and an insertion space therein for housing a micro SD flash memory card, a rear edge of said lower cover further including a row of holes and a deficit corner corresponding to said deficit corner of said upper cover;

an envelope made of insulating material and confined in an inner space of said combined structure near a rear end of said combined structure;

a set of conducting terminals confined in said inner space between said upper cover and said lower cover, each of said conducting terminals being an elongated metallic plate that has a wide end and an upwardly bent narrow end, said conducting terminals being collaterally shrunk from said wide ends toward said narrow ends, said row of holes being connected to said wide ends of said conducting terminals; and a detecting/retaining arm extended from the farthest left of said conducting terminals toward said front end of said combined structure for connecting an opening of an inserted micro SD flash memory card, said detecting/retaining arm further comprising a connecting plate and two uprightly folded guiding members, one of said guiding members having a bent portion, the other said guiding members having a hook tip.

2. The simulated SD memory card converter of claim 1 wherein a front edge and two lateral edges of said lower cover are respectively provided with a plurality of projections, and wherein a front edge and two lateral edges of said upper cover are respectively provided with a plurality of depressions corresponding to said projections, whereby said projections and said depressions will be engaged upon the combination of said upper cover and said lower cover.

3. The simulated SD memory card converter of claim 1 wherein a front edge opposite to said rear edge and said rear edge of said lower cover are provided with upwardly projected flanges for securing the disposition of said upper cover thereon.

4. The simulated SD memory card converter of claim 1 wherein the side of said main opening on said lower cover is curved inward.

5. The simulated SD memory card converter of claim 1 wherein said envelope further includes a plurality of through holes for retaining said conducting terminals confined therein, and wherein said conducting terminals are attached with a connecting strip and a base strip for maintaining the spatial arrangement of said conducting terminals during a process of combining said envelope and said conducting terminals, said connecting strip and said base strip being punched away after said process.

* * * * *